US011635232B2

(12) United States Patent
Chase

(10) Patent No.: US 11,635,232 B2
(45) Date of Patent: Apr. 25, 2023

(54) HVAC SYSTEM FLAME SENSOR

(71) Applicant: Johnson Controls Technology Company, Auburn Hills, MI (US)

(72) Inventor: Thomas D. Chase, Wichita, KS (US)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 0 days.

(21) Appl. No.: 17/212,938

(22) Filed: Mar. 25, 2021

(65) Prior Publication Data

US 2021/0302069 A1 Sep. 30, 2021

Related U.S. Application Data

(60) Provisional application No. 63/000,149, filed on Mar. 26, 2020.

(51) Int. Cl.
*F24H 9/20* (2022.01)
*F23N 5/24* (2006.01)

(52) U.S. Cl.
CPC ..... *F24H 9/2085* (2013.01); *F23N 5/242* (2013.01); *F23N 2229/12* (2020.01)

(58) Field of Classification Search
CPC . F23N 2900/05005; F23N 5/123; H01B 7/28; H01B 7/2806; H01B 7/29; H01B 7/292; H01B 7/295; H01B 1/02; B32B 15/018
See application file for complete search history.

(56) References Cited

U.S. PATENT DOCUMENTS 2,782,103 A * 2/1957 Prentiss ..... G01N 27/626 73/23.31
4,029,966 A * 6/1977 Baker ..... G01J 5/0088 250/372
4,140,475 A * 2/1979 Wolfe ..... F23D 14/725 431/76
4,203,779 A * 5/1980 Kojima ..... H01L 35/20 137/66
4,272,349 A * 6/1981 Furutani ..... G01N 27/4077 204/429
4,318,687 A * 3/1982 Inoue ..... F23N 5/105 431/54
4,398,882 A 8/1983 Yamana
(Continued)

FOREIGN PATENT DOCUMENTS

CN 1699990 A * 11/2005
CN 201462910 U 5/2010
(Continued)

*Primary Examiner* — Vivek K Shirsat
(74) *Attorney, Agent, or Firm* — Fletcher Yoder, P.C.

(57) ABSTRACT

A flame sensor for a furnace of a heating, ventilation, and air conditioning (HVAC) system includes a sensor body and an electrically conductive member of the sensor body. The electrically conductive member is configured to be disposed within a flame region of a burner of the furnace and configured to receive electrical current from a controller of the furnace. The flame sensor also includes an anti-oxidation coating disposed on an outer surface of the electrically conductive member and configured to transmit the electrical current from the electrically conductive member. The anti-oxidation coating is configured to contact a flame produced by the burner and expose the electrical current to the flame.

20 Claims, 7 Drawing Sheets

(56) References Cited

U.S. PATENT DOCUMENTS

| | | | | | |
|---|---|---|---|---|---|
| 5,472,336 | A * | 12/1995 | Adams | F23N 5/123 | 431/2 |
| 9,927,382 | B2 * | 3/2018 | Freymiller | F23Q 3/006 | |
| 2012/0288806 | A1 * | 11/2012 | Racaj | F23N 5/123 | 431/18 |
| 2016/0047548 | A1 * | 2/2016 | Farley | F24D 19/1084 | 126/116 A |
| 2019/0162408 | A1 * | 5/2019 | Eadie | F23N 5/24 | |
| 2021/0140636 | A1 * | 5/2021 | Vie | F23N 5/12 | |

FOREIGN PATENT DOCUMENTS

| | | | | | |
|---|---|---|---|---|---|
| CN | 102192534 | A | | 9/2011 | |
| CN | 202101292 | U | | 1/2012 | |
| CN | 109253467 | A | * | 1/2019 | B05D 7/14 |
| CN | 208998935 | U | | 6/2019 | |
| DE | 202015104356 | U1 | * | 10/2015 | F23D 14/72 |
| EP | 579157 | B1 | | 1/1994 | |
| JP | H0575157 | A | | 3/1993 | |
| JP | 2003232515 | A | * | 8/2003 | F23D 14/72 |

* cited by examiner

HVAC SYSTEM FLAME SENSOR

CROSS REFERENCE TO RELATED APPLICATION

This application claims priority from and the benefit of U.S. Provisional Application Ser. No. 63/000,149, entitled "ANTI-OXIDATION FLAME SENSOR," filed Mar. 26, 2020, which is hereby incorporated by reference in its entirety for all purposes.

BACKGROUND

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Heating, ventilation, and air conditioning (HVAC) systems are used in many residential and commercial environments to control the climate of an inhabited space. To provide heating capabilities, many HVAC systems employ a gas burner to generate heat. Gas burners generally operate by igniting a gaseous mixture of air and fuel within a controlled space to create combustion products. The combustion products then flow through tubes of a heat exchanger. The HVAC system directs air across the tubes of the heat exchanger, and the air absorbs heat from the combustion products flowing within the tubes to create a heated air flow. The heated air flow may then be directed to a conditioned space.

Gas furnaces may include a flame sensor to detect the presence of a flame during operation of the gas furnace. For example, the flame sensor may verify and/or confirm the presence of a flame during gas furnace operation. The HVAC system may adjust operation of the gas furnace based on feedback from the flame sensor. The flame sensor may be exposed to open flames and associated high temperatures within the gas furnace. Unfortunately, existing flame sensors may be susceptible to wear and degradation, which may impact operation and/or performance of the flame sensor.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a flame sensor for a heating, ventilation, and air conditioning (HVAC) system includes a sensor body and an electrically conductive member of the sensor body. The electrically conductive member of the sensor body is configured to be disposed within a flame region of a burner of the furnace and configured to receive electrical current from a controller of the furnace. The flame sensor also includes an anti-oxidation coating disposed on an outer surface of the electrically conductive member and configured to transmit the electrical current from the electrically conductive member. The anti-oxidation coating is configured to contact a flame produced by the burner and expose the electrical current to the flame.

In another embodiment, a furnace includes a burner configured to produce a flame within a flame region of the burner. The furnace also includes a flame sensor coupled to the burner. The flame sensor includes an electrically conductive member disposed within the flame region of the burner. The electrically conductive member is configured to receive electrical current from a controller of the furnace. The flame sensor also includes an anti-oxidation coating disposed on an outer surface of the electrically conductive member and configured to transmit the electrical current from the electrically conductive member. The anti-oxidation coating is configured to contact the flame produced by the burner and expose the electrical current to the flame.

In another embodiment, a flame sensing system for a furnace of a heating, ventilation, and air conditioning (HVAC) system includes a flame sensor configured to be disposed within a flame region of a burner of the furnace. The flame sensor includes a main body portion formed from a metallic material and configured to receive electric current from a controller of the furnace. The flame sensor also includes an anti-oxidation coating formed on an outer surface of the main body portion. The anti-oxidation coating is formed from a noble metal and is configured to transmit the electric current from the main body portion.

BRIEF DESCRIPTION OF THE DRAWINGS

Various aspects of the present disclosure may be better understood upon reading the following detailed description and upon reference to the drawings, in which.

DETAILED DESCRIPTION

Figure 1:
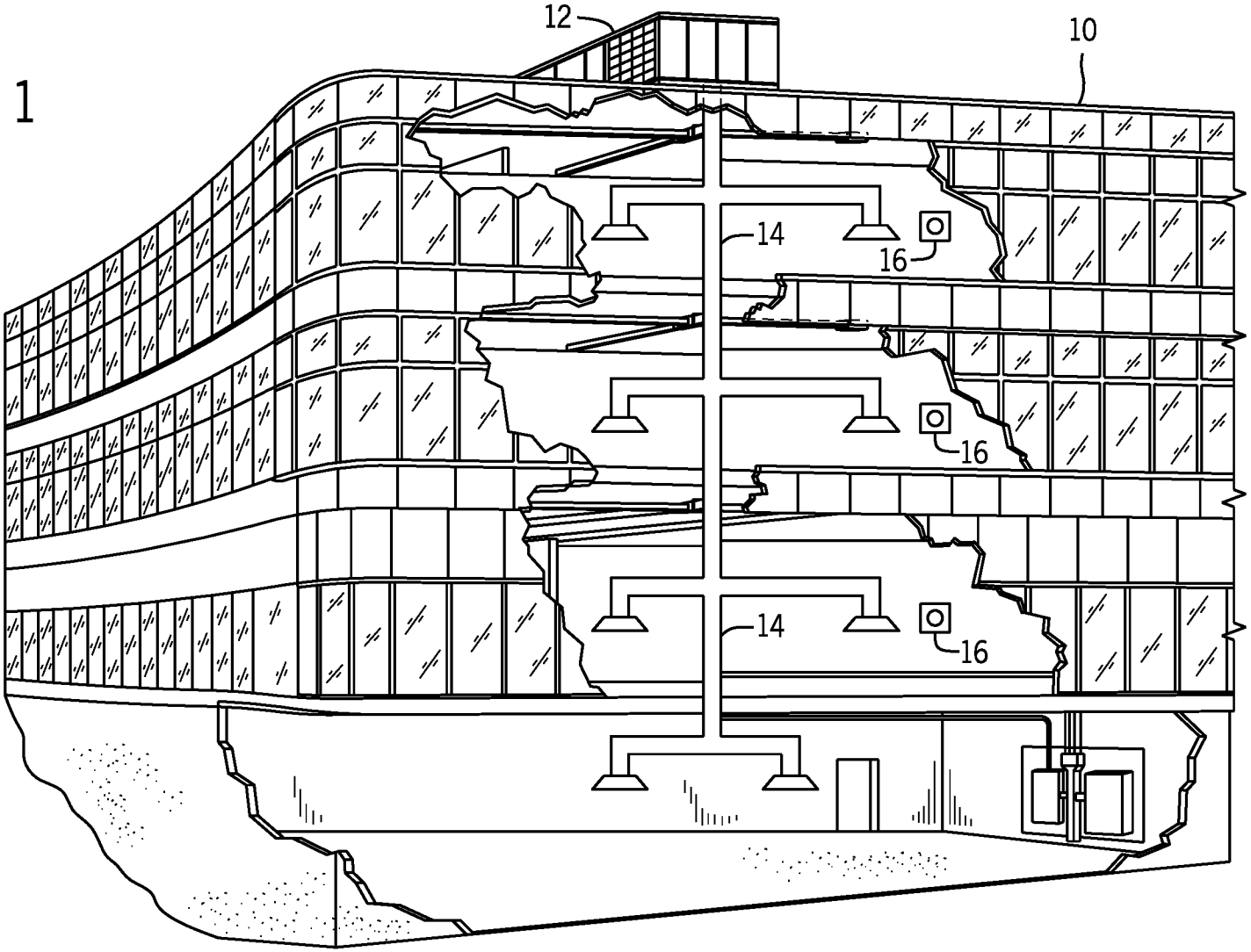
FIG. 1 is a perspective view of an embodiment of a building that may utilize a heating, ventilation, and/or air conditioning (HVAC) system in a commercial setting, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

It may be desirable to verify a presence of a flame created by the burner in order to coordinate operation of the furnace system and the HVAC system generally. For example, a furnace system may include a flame sensor configured to detect the presence of the flame. The flame sensor may detect the presence of the flame and provide feedback indicative of flame presence. In some embodiments, the HVAC system may regulate supply of fuel to the burner based on the feedback provided by the flame sensor. In this way, the furnace system may avoid waste of fuel and/or enable more efficient operation. One type of flame sensor that may be utilized in the furnace system is a flame rectification sensor.

Flame rectification sensors may operate based on the phenomenon of flame rectification to detect the presence of a flame produced by a burner. A sensor body may be positioned in the furnace system such that at least a portion of a flame rod is positioned within a flame path (e.g., flame region) of the burner. Thus, when the burner is ignited and producing a flame, the flame may contact the flame rod. In operation, a control system may provide an alternating current to the sensor body. The control system may also be electrically grounded in the furnace system (e.g., to a burner assembly). When no flame in present, an electrical potential may exist across (e.g., between) the sensor body and the burner assembly. When a flame is present, ions present in the flame may form a conductive path (e.g., a direct conductive path) between the burner assembly and the sensor body, thereby creating a completed electrical circuit through the sensor body, the flame, the burner assembly, and/or the control system of the HVAC system. The conductive path may allow a direct current to flow in the completed electrical circuit. The control system may detect the presence of the flame via the presence of the direct current flowing through the electrical circuit.

The sensor body may be formed from a conductive metal capable of withstanding high temperatures. Additionally, in order to control or regulate compounds within the combustion products, many burners may operate at high temperatures. Unfortunately, at some high temperatures, a nonconductive oxide coating may form on a surface of the sensor body, which may affect the ability of the flame sensor to form the conductive path between the sensor body and the burner assembly in the presence of the flame. Therefore, it may be desirable to reduce oxidation of the sensor body that may be caused by exposure to high temperatures.

Accordingly, present embodiments are directed to a flame rectification sensor including a sensor body with a conductive anti-oxidation coating formed on a surface (e.g., an outer surface) of the sensor body. As discussed below, the conductive anti-oxidation coating may be a thin coating of a material that is conductive, resistant to oxidation, and configured to withstand a high temperature environment. In this way, the present embodiments enable improved operation of a flame rectification sensor by reducing formation of an oxide coating on the surface of a sensor body, thereby improving reliable flame detection and extending a useful life of the flame rectification sensor.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
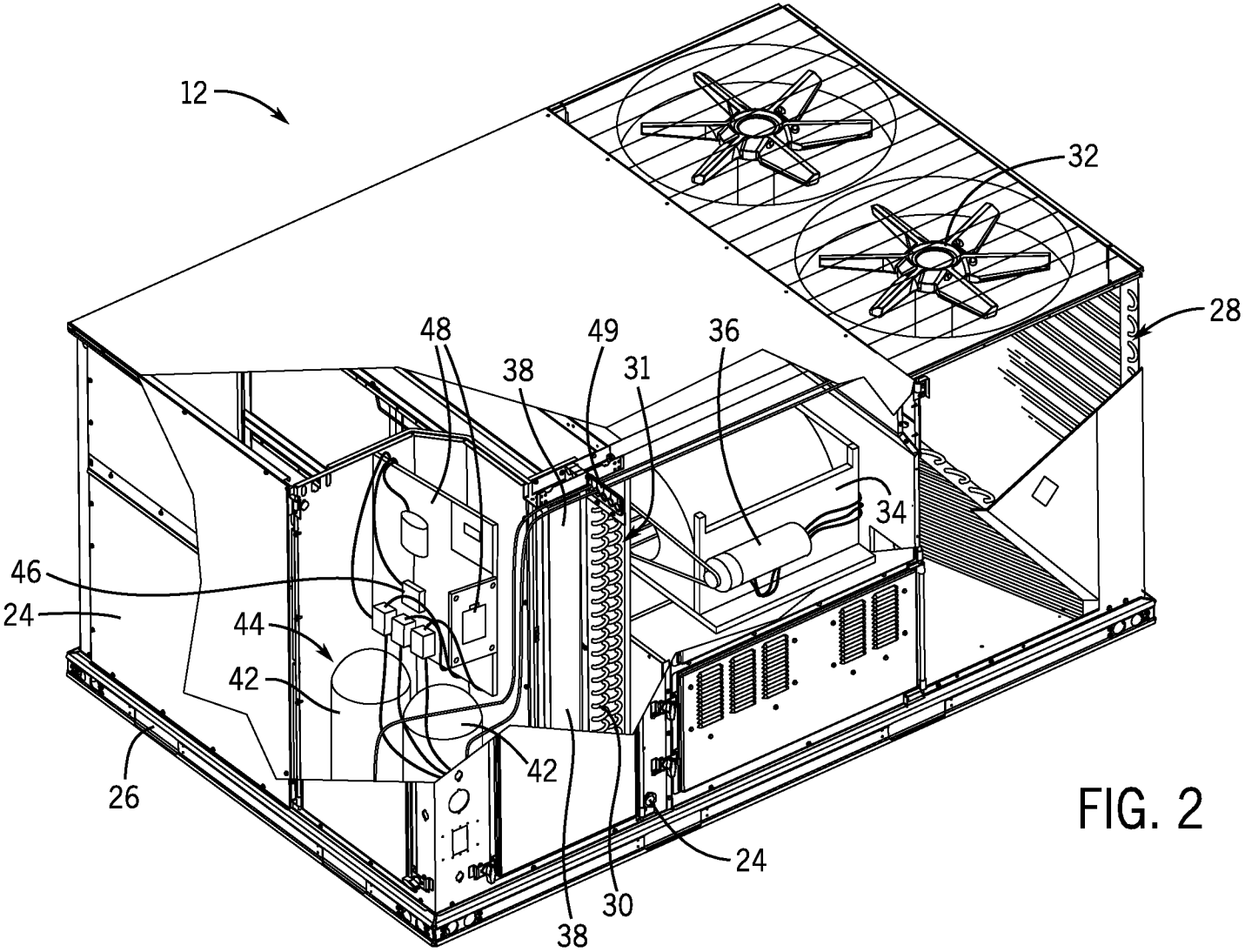
FIG. 2 is a perspective view of an embodiment of a packaged HVAC unit, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
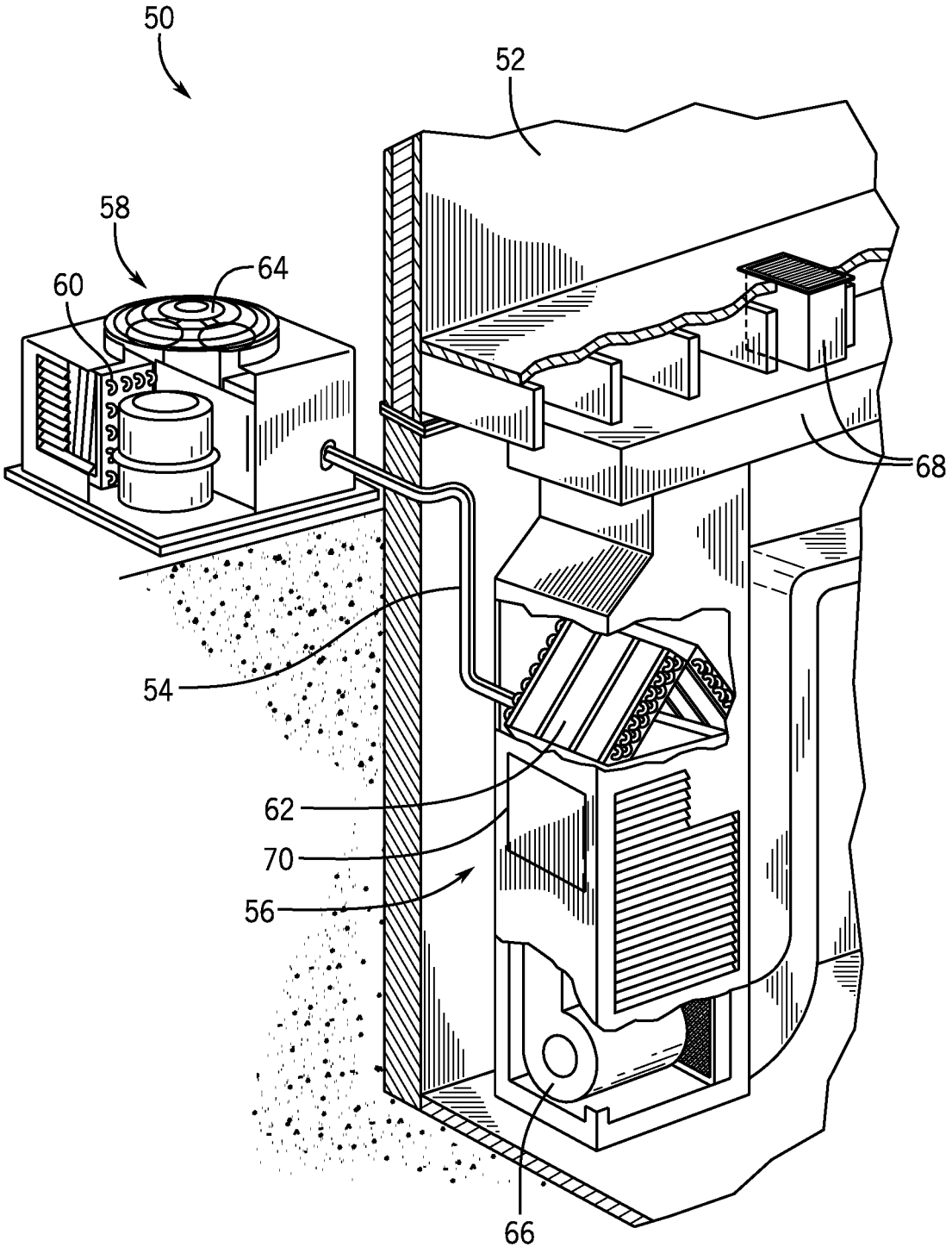
FIG. 3 is a perspective view of an embodiment of a split, residential HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
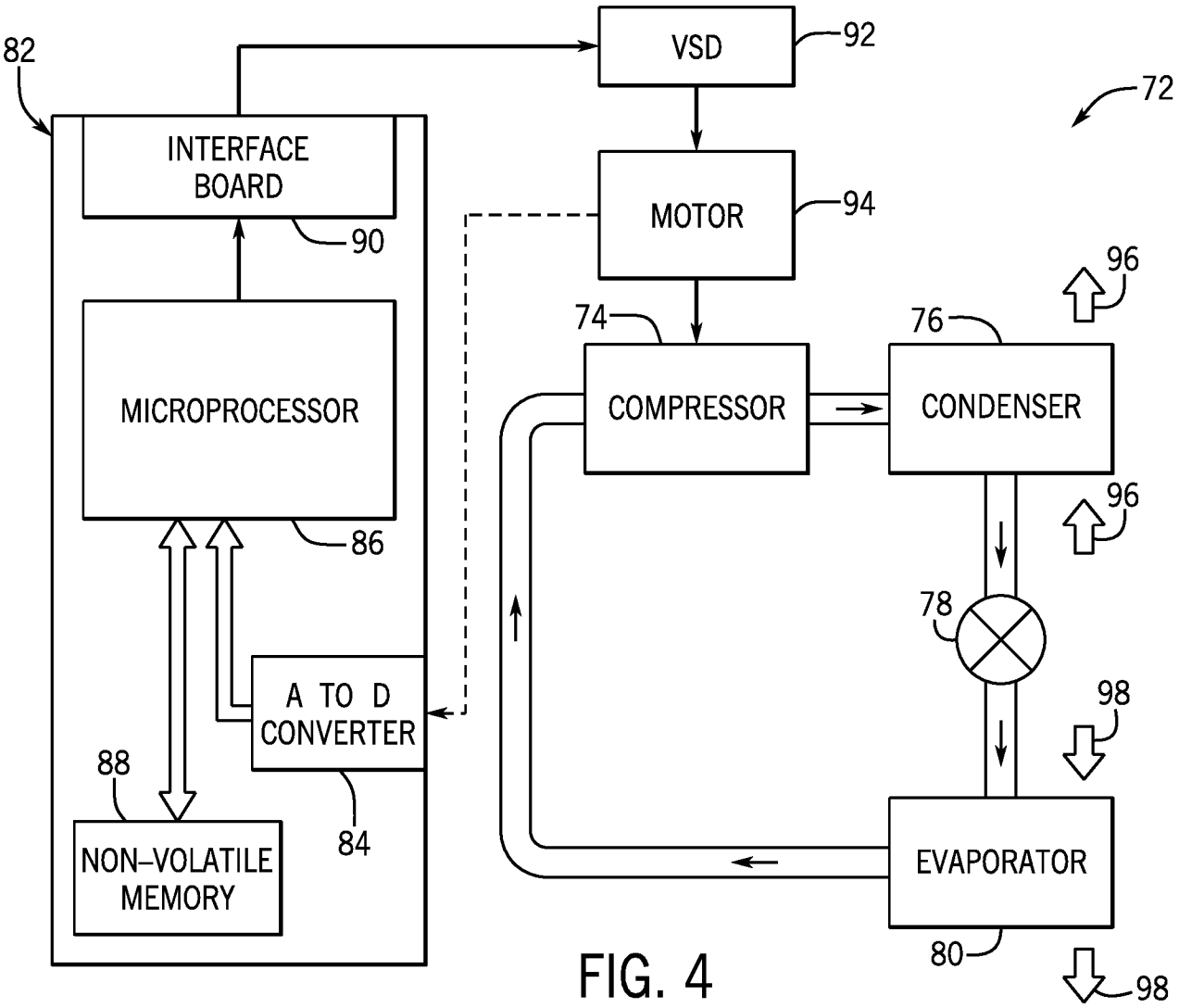
FIG. 4 is a schematic diagram of an embodiment of a vapor compression system that may be used in an HVAC system, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As briefly discussed above, present embodiments are directed to a flame sensor including a sensor body with a conductive anti-oxidation coating formed on a surface (e.g., an outer surface) of the sensor body. The flame sensor (e.g., flame rectification sensor) is configured to detect the presence of a flame in an HVAC system, such as in the HVAC unit 12 or the furnace system 70 of the indoor unit 56 discussed above. For example, the flame sensor may be positioned within a flame path of a burner of the furnace system 70, such that a flame generated by the burner contacts the sensor body of the flame sensor. As mentioned above, contact between the sensor body and the flame may create an electrical flow path and/or complete an electrical circuit through the flame sensor and the burner (e.g., furnace 70) that is utilized to verify the presence of the flame. The conductive anti-oxidation coating formed on the sensor body is conductive, resistant to oxidation, and configured to withstand a high temperature environment. In particular, the conductive anti-oxidation coating is configured to resist, inhibit, block, and/or prevent oxidation that may otherwise occur due to the high temperature and/or oxygen levels to which the flame sensor is exposed. For example, the sensor body may be formed from a material that may be susceptible to oxidation, but oxidation may be inhibited or prevented via the conductive anti-oxidation coating. Further, the conductive anti-oxidation coating enables formation of an electrical flow path and/or completion of an electrical circuit through the flame sensor and the burner. In this way, present embodiments of the flame sensor improve a useful life and reliable operation of the flame sensor.

Figure 5:
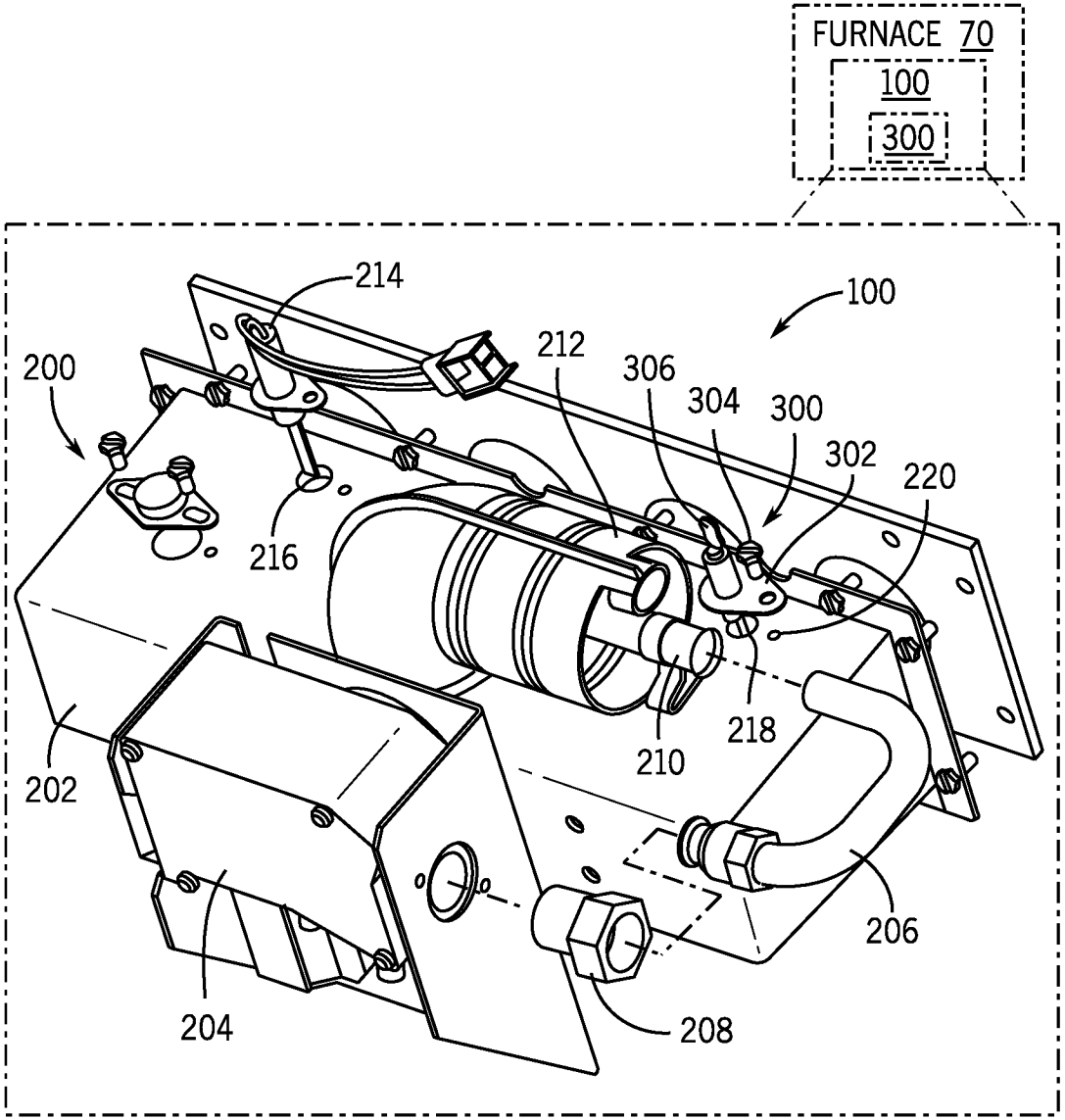
FIG. 5 is a perspective view of an embodiment of a burner including a flame sensor for detecting the presence of a flame within the burner, in accordance with aspects of the present disclosure.

FIG. 5 is a partially exploded perspective view of a burner assembly 100. The burner assembly 100 may be incorporated within the HVAC unit 12, the furnace system 70, or another heating system of an HVAC system. In the illustrated embodiment, the burner assembly 100 includes a burner 200 (e.g., a burner unit) configured to generate combustion products that may be used to heat an air flow, such as a supply air flow directed to a conditioned space. The burner 200 includes a burner housing 202 (e.g., a burner box) configured to receive flows of fuel and air for combustion. The generated combustion products may then be directed through tubes (e.g., heat exchanger tubes) for use in heating the air flow. The burner housing 202 may be formed from any material suitable for exposure to high temperatures, such as steel or another metallic material.

The burner housing 202 may define a combustion chamber of the burner 200. For example, the burner 200 may include burner tubes disposed within the burner housing 202, and the burner assembly 100 may direct respective flows of air and fuel into the burner housing 202 for combustion via the burner tubes. To this end, the burner assembly 100 includes a fuel valve 204 configured to control flow of fuel (e.g., liquid fuel, gaseous fuel, etc.) into the burner 200. The fuel valve 204 may receive fuel from a fuel source and direct a flow of the fuel into a tube 206 (e.g., a conduit, a manifold) via a fuel outlet 208 (e.g., outlet fitting, outlet connector, etc.) of the fuel valve 204. The tube 206 is configured to direct the flow of fuel to a fuel inlet 210 of the burner 200. In other words, the tube 206 may be fluidly coupled to (e.g., secured to) the fuel valve 204 and to the burner 200 to direct fuel from the fuel valve 204 to the burner 200. The burner 200 also includes an air inlet 212 (e.g., conduit, intake) configured to receive a flow of air and direct the flow of air into the burner housing 202 for mixture with the fuel received via the fuel inlet 210.

The flows of fuel and air received by the burner 200 may be mixed to create a reactant mixture that is ignited within the burner housing 202. For example, the burner 200 may include an igniter 214 that is mounted to the burner housing 202 and extends at least partially into the burner housing 202 (e.g., into the combustion chamber defined by the burner housing 202) via an aperture 216 formed in the burner housing 202. The igniter 214 may be a device capable of igniting a reactant mixture. For example, the igniter 214 may be an electronic device capable of producing a spark when supplied with a current. The igniter 214 may produce a flame and ignite the reactant mixture (e.g., air-fuel mixture), thereby generating combustion products that may be discharged into tubes of a heat exchanger, such as tubes of the furnace 70.

The burner assembly 100 may also include a flame sensor 300 to detect the presence of a flame during operation of the burner assembly 100. For example, the flame sensor 300 may be mounted to the burner housing 202 and may extend at least partially into the burner housing 202 (e.g., into the combustion chamber defined by the burner housing 202) via an aperture 218 formed in the burner housing 202. In the illustrated embodiment, the flame sensor 300 includes a mounting portion 302 (e.g., a mounting flange) configured to secure the flame sensor 300 to the burner housing 202. For example, a fastener 304 may extend through the mounting portion 302 and through a mounting aperture 220 of the burner housing 202 to attach the flame sensor 300 to the burner housing 202.

As discussed in further detail below, the flame sensor 300 may include a sensor rod configured to be disposed within a flame path of the burner 200. For example, the sensor rod may be disposed in a space within the burner housing 202 that is occupied by a flame produced by the burner 200 during normal operation of the burner assembly 100. In some embodiments, the sensor rod may be positioned adjacent to the igniter 212, adjacent to a burner tube within the burner housing 202, or at another suitable location at which a flame is located during operation of the burner 200. In this manner, the burner assembly 100 is configured to establish contact between the flame sensor 300 and the flame during operation of the burner assembly 100.

As will be appreciated, visual inspection of the flame (e.g., within the burner housing 202) may be blocked by the burner housing 202. Thus, the flame sensor 300 is configured to enable verification of the presence of the flame to establish intended operation of the burner assembly 100. To this end, the flame sensor 300 is configured to create a conductive path (e.g., electrical circuit) between the flame sensor 300 and the burner assembly 100 via the flame. For example, in the presence of a flame (e.g., upon contact between the flame and the flame sensor 300), a conductive path extending from the flame sensor 300 to the burner assembly 100 may be created through the flame via ions present in the flame. In operation, an electrical current (e.g., alternating current) may be supplied to the flame sensor 300 by a control system of the HVAC system having the burner assembly 100. For example, the flame sensor 300 may be electrically coupled to the control system via a connector 306 of the flame sensor 300. When a flame contacts the flame sensor 300 (e.g., the sensor rod disposed within the burner housing 202), direct current may flow along the conductive path from the flame sensor 300, through the flame, and to a grounded component of the burner assembly 100. The direct current may be detected by the control system to verify the presence of the flame and establish intended operation of the burner assembly 100.

Figure 6:
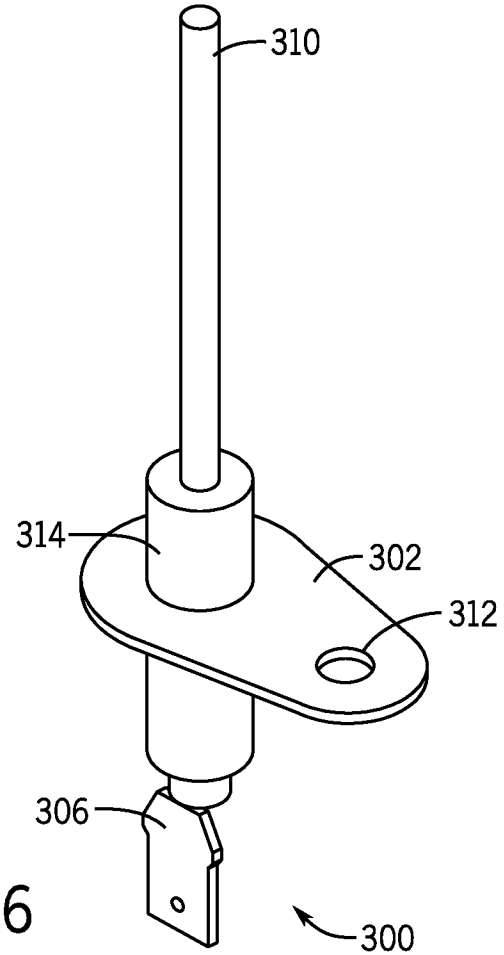
FIG. 6 is a perspective view of an embodiment of a flame sensor that may be utilized with the burner of FIG. 5, in accordance with aspects of the present disclosure.

FIG. 6 is a perspective view of an embodiment of the flame sensor 300. As mentioned above, the flame sensor 300 may include a sensor body 310 configured to be disposed within the burner housing 202, such as in a flame path within the burner housing 202. To this end, the sensor body 310 may have a generally extended geometry, such as that of a rod, a cylinder, an elongated rectangular prism, or other suitable geometry. The sensor body 310 is also configured to conduct an electrical current. The sensor body 310 may be from any suitable electrically-conductive material configured to transmit an electric current and withstand elevated temperatures of the flame and operation of the burner 200. Details of the sensor body 310 are discussed in further detail below with reference to FIG. 7.

The flame sensor 300 may include a number of other components. The flame sensor 300 may be mounted to the burner assembly 100 via the mounting portion 302, as discussed above. The mounting portion 302 may be formed from a metal or any other material configured to withstand elevated temperatures produced during operation of the burner assembly 100. The fastener 304 may interface extend through a mounting aperture 312 on the mounting portion 302 and through the mounting aperture 220 of the burner housing 202 to secure the flame sensor 300 to the exterior of the burner assembly 100. The flame sensor 300 may also include an insulation portion 314 extending about a portion of the sensor body 310. In an assembled configuration of the flame sensor 300, the insulation portion 314 may be disposed within the aperture 218 of the burner housing 202 to block direct contact (e.g., to electrically isolate) between the sensor body 310 and the burner housing 202. In some embodiments, the insulation portion 314 also extends through the mounting portion 302 to block direct contact between (e.g., to electrically isolate) the sensor body 310 and the mounting portion 302. In other words, the mounting portion 302 may be disposed about the insulation portion 314. The insulation portion 314 may have a cylindrical geometry and/or may have a geometry corresponding to a geometry of the aperture 218 through which the flame sensor 300 extends and in which the insulation portion 314 is disposed. The insulation portion 314 may be formed from any suitable electrically-insulating material. The material of the insulation portion 314 may also be configured to withstand elevated temperatures generated during operation of the burner assembly 100.

As mentioned above, the flame sensor 300 may also include the connector 306 configured to electrically connect the sensor body 310 to a control system, such as a controller of the furnace system 70. The connector 306 may receive an electric current from the control system and direct the electric current to the sensor body 310. As with the sensor body 310, the connector 306 may be formed from any suitable electrically-conductive metal configured to withstand elevated temperatures. In some embodiments, the connector 306 and the sensor body 310 may be formed from the same material or from different materials. In some embodiments, the connector 306 may be integrally formed with the sensor body 310. As described in further detail below, the electric current provided to the sensor body 310 via the connector 306 may be transmitted through a flame to another component (e.g., a grounded component) of the burner 200 and/or burner assembly 100 to verify the presence of the flame during operation of the burner assembly 100.

Figure 7:
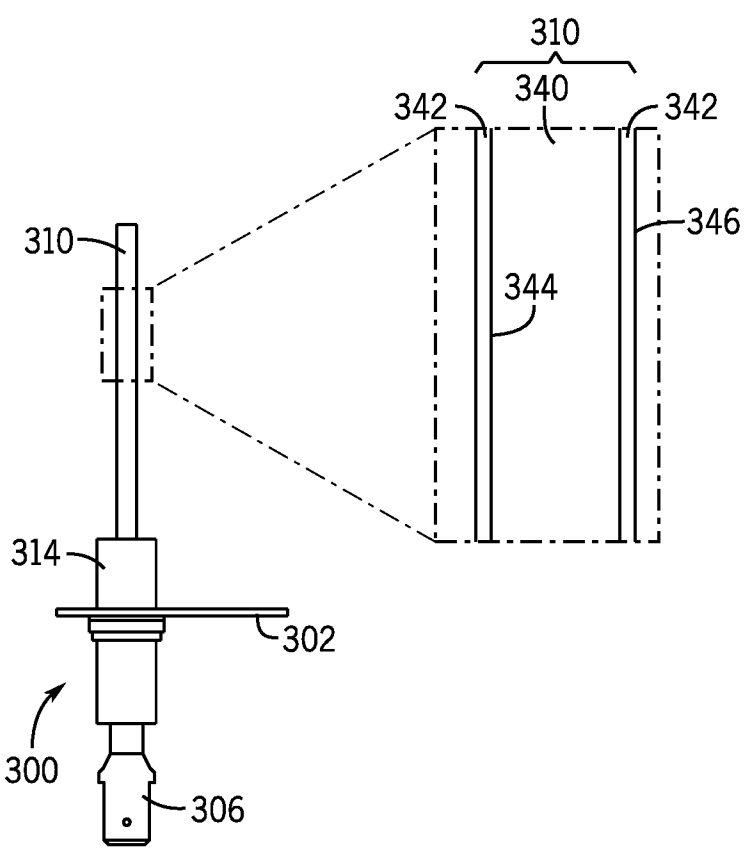
FIG. 7 is a side view of an embodiment of a flame sensor, illustrating a cross sectional view of a sensor body, in accordance with aspects of the present disclosure.

In accordance with present techniques, the flame sensor 300 includes a coating disposed on the sensor body 310 to block, mitigate, and/or prevent oxidation of the sensor body 310 during operation of the burner 200. As will be appreciated, some metallic materials may be susceptible to oxidation in the presence of elevated temperatures and/or oxygen levels. An oxidized layer formed on the metallic material may block flow of electric current, which may cause the flame sensor 300 to function improperly. Thus, present embodiments of the flame sensor 300 are configured to block, mitigate, and/or prevent oxidation of the sensor body 310 and enable proper function of the flame sensor 300. For example, FIG. 7 is a side view of an embodiment of the flame sensor 300, illustrating a cross section of the sensor body 310. As shown, the sensor body 310 may include a main body 340 (e.g., main body portion, interior portion, electrically conductive member) formed from an electrically conductive material. The main body 340 may be formed from any suitable material configured to conducting electricity and withstand elevated temperatures (e.g., temperatures of a flame, temperatures of combustion products, etc.). For example, the main body 340 may be formed from KANTHAL® material. KANTHAL® is an iron-chromium-aluminum (FeCrAl) alloy including at least 70% iron, 20-30% chromium, and 4-7% aluminum. In another example, the main body 340 may be formed from an alloy including nickel-chromium (NiCr) or chromium-nickel (CrNi) alloy (Nichrome), a metallic material, such as aluminum, or other suitable electrically-conductive material.

The sensor body 310 also includes an anti-oxidation coating 342. The anti-oxidation coating 342 may be a layer of material that is oxidation-resistant material and is also electrically conductive. As shown, the anti-oxidation coating 342 may be formed on an outer surface 344 of the main body 340 of the sensor body 310. For example, the anti-oxidation coating 342 may be formed on the outer surface 344 of the main body 340 via electroplating, vacuum deposition, thermal decomposition and chemical vapor plating, metallising, metallic bonding, electroless deposition, or other suitable process or technique. In some embodiments, the anti-oxidation coating 342 may be formed on a portion of the outer surface 344 of the main body 340, but in other embodiments, the anti-oxidation coating 342 may be formed on an entirety of the outer surface 344.

In some embodiments, the anti-oxidation coating 342 may be formed from a noble metal. In one example, the anti-oxidation coating 342 may be formed from platinum (Pt) or a platinum alloy. Other examples of material used to form the anti-oxidation coating 342 may include another noble metal or noble metal alloy, such as gold (Au), silver (Ag), palladium (Pd), or the like. In some embodiments, the main body 340 and the anti-oxidation coating 342 may both be formed from a noble metal and/or a noble metal alloy. For example, the anti-oxidation coating 342 may be formed from a noble metal alloy having a first percentage of noble metal, and the main body 340 may be formed from a noble metal alloy having a second percentage of noble metal that is less than the first percentage. In other words, the main body 340 and the anti-oxidation coating may be made from a noble metal alloys of different purities. In further embodiments, the anti-oxidation coating 342 may be formed from other electrically-conductive materials that are oxidation resistant, such as ceramics (e.g., silicon carbide).

In an installed configuration of the flame sensor 300, the sensor body 310 may be disposed within a flame path of the burner assembly 100, such that the sensor body 310 may contact a flame produced by the burner 200. Thus, the anti-oxidation coating 342, which forms an outermost surface 346 of the sensor body 310, may be exposed to the flame instead of the main body 340 of the sensor body 310. Due to the anti-oxidation properties of the anti-oxidation coating 342, the sensor body 310 may not form an oxide layer in the presence of the flame during operation of the burner assembly 100. Additionally, the electrically-conductive properties of the anti-oxidation coating 342 enables conduction of an electric current from the main body 340 to the flame, which enables verification and/or detection of the flame. The anti-oxidation properties and electrical conductivity of the anti-oxidation coating 342 is described in detail below with reference to FIGS. 8 and 9.

Figure 8:
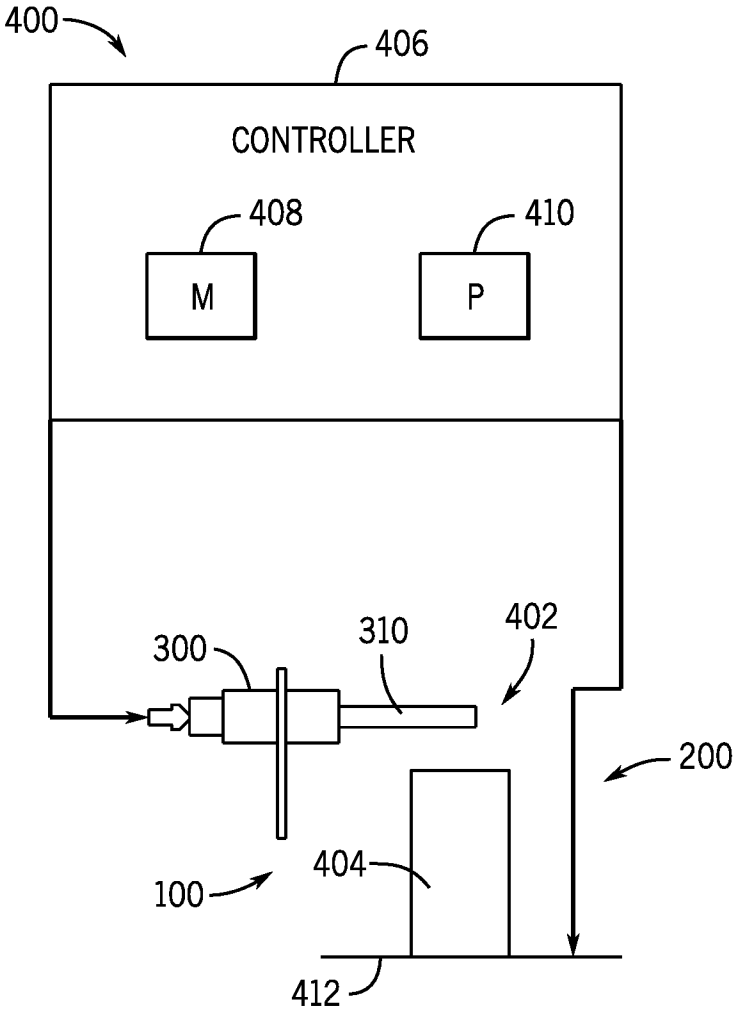
FIG. 8 is a schematic of an embodiment of a flame sensor system, illustrating operation of the flame sensor system without a flame present, in accordance with aspects of the present disclosure.

FIG. 8 is a schematic of an embodiment of a flame sensor system 400 including the flame sensor 300. The flame sensor system 400 is configured to enable detection of a flame within the burner assembly 100 and/or within another heating system configured to generate or produce a flame. As discussed above, the flame sensor 300 is configured to extend at least partially into the burner 200 and/or burner housing 202 of the burner assembly 100 in an installed configuration. Specifically, the sensor body 310 of the flame sensor 300 may be disposed within a flame path or flame region 402 of the burner assembly 100. For example, the flame path 402 may be a region within the burner housing 202 adjacent to a burner tube 404 of the burner 200, adjacent to the igniter 212, and/or another location in which a flame is present during normal operation of the burner assembly 100.

In addition to the flame sensor 300, the flame sensor system 400 may include a controller 406 (e.g., a control system), which may be a controller of the furnace 70 or the HVAC unit 12, the control board 48, the control panel 82, or other control system. The controller 406 includes a memory 408 and a processor 410 (e.g., a microprocessor). The processor 410 may be configured to execute software, such as software for detecting a type of current present at the flame sensor 300. Moreover, the processor 410 may include multiple microprocessors, one or more "general-purpose" microprocessors, one or more special-purpose microprocessors, and/or one or more application specific integrated circuits (ASICS), or some combination thereof. For example, the processor 410 may include one or more reduced instruction set (RISC) or complex instruction set (CISC) processors. The memory 408 may include a volatile memory, such as random access memory (RAM), and/or a nonvolatile memory, such as read-only memory (ROM). The memory 408 may store a variety of information and may be used for various purposes. For example, the memory 408 may store processor-executable instructions (e.g., firmware or software) for the processor 410 to execute, such as instructions for delivering an alternating current to the flame sensor 300 and for detecting if the alternating current is rectified to a direct current. The memory 408 and/or the processor 410, or an additional memory and/or processor, may be located in any suitable portion of an HVAC system having the flame sensor 300, such as within the furnace system 70.

In operation, the controller 406 may be configured to supply an alternating current to the flame sensor 300 and detect whether the current is rectified to a direct current (e.g., via the presence of a flame contacting the flame sensor 300). The controller 406 may be electrically connected to the flame sensor 300 via the connector 306. The controller 406 may also be grounded to the burner assembly 100 (e.g., to the burner 200). In one example, the controller 406 may be electrically grounded directly to a component of the burner 200, such as the burner housing 202 or a mounting structure 412 coupled to the burner tube 404. In another embodiment, the controller 406 may be grounded to another part of the burner assembly 100 that may conduct a current to and/or from the burner 200.

In the illustrated embodiment, the burner tube 404 of the burner 200 does not produce a flame. Thus, the sensor body 310 of the flame sensor 300 does not contact a flame. As the controller 406 applies a current (e.g., alternating current) to the flame sensor 300 (e.g., to the sensor body 310), the current may remain at the sensor body 310 and/or may not transfer from the sensor body 310 to the burner tube 404 and/or the burner 200. Thus, an electric potential may form between the burner 200 and the flame sensor 300. The controller 406 may monitor the flame sensor 300 to detect that the current at the flame sensor 300 is an alternating current. In other words, the flame sensor 300 may provide feedback to the controller 406 indicative of the current being alternating current. Based on the detection, the controller 406 may determine that no flame is present within the burner 200. In some embodiments, the controller 406 may control or adjust operation of the burner assembly 100 based on the detection and/or determination. For example, based on a determination that a flame is not present, the controller 406 may adjust operation of the fuel valve 204 to suspend and/or interrupt supply of fuel to the burner 200. In another example, the controller may activate the igniter 212 based on the determination that no flame is present in the burner 200.

Figure 9:
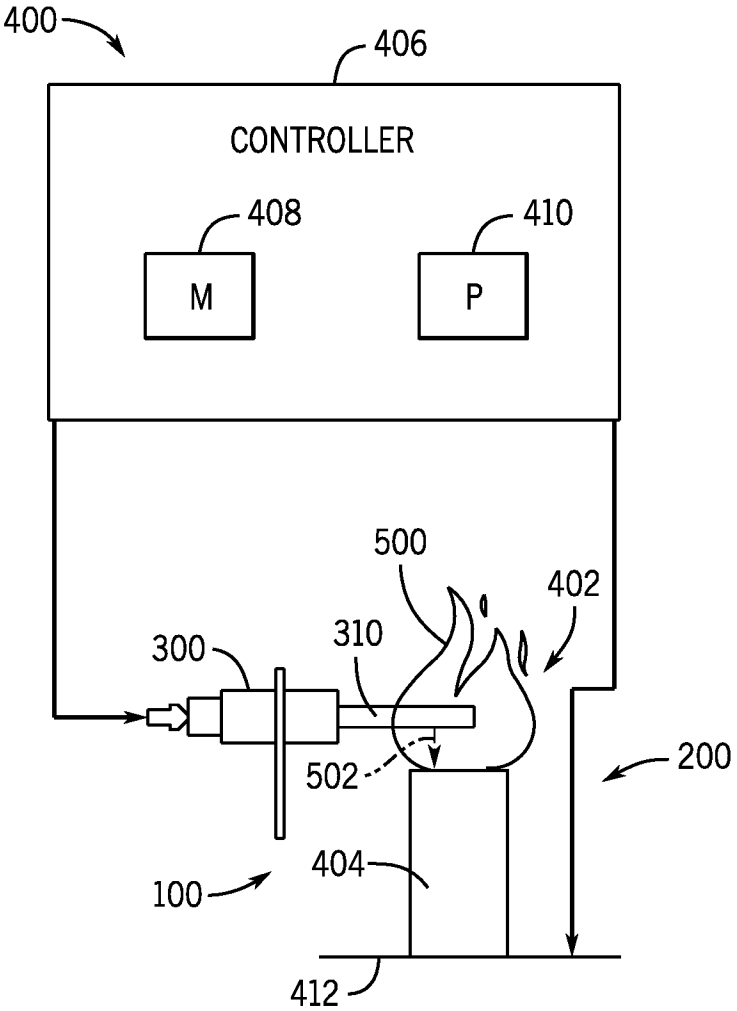
FIG. 9 is a schematic of an embodiment of a flame sensor system, illustrating operation of the flame sensor system with a flame present, in accordance with aspects of the present disclosure.

FIG. 9 is a schematic of an embodiment the flame sensor system 400 including the flame sensor 300 and illustrating presence of a flame 500 produced by the burner tube 404 of the burner 200. The flame 500 may be present when the burner 200 is operating (e.g., operating normally). As described above, the sensor body 310 is positioned to be at least partially disposed within the flame path 402 of the burner 200. The flame 500 may come into contact (e.g., direct contact) with the sensor body 310. More specifically, the flame 500 may contact the anti-oxidation coating 342 of the sensor body 310. The flame 500 may produce ions that create an electrically conductive path between the flame sensor 300 and the burner 200 (e.g., the burner tube 404), as indicated by arrow 502. The conductive path 502 may create an electric circuit (e.g., a completed electric circuit) extending from the controller 406, to the flame sensor 300, through the main body 340 and the anti-oxidation coating 342 of the sensor body 310, through the flame 500, and to the burner 200, which is grounded to the controller 406. Thus, a current may be transmitted through the conductive path 502 from the flame sensor 300 to the burner 200 (e.g., the burner tube 404 and/or the mounting structure 412). In this way, the alternating current provided by the controller 406 to the flame sensor 300 may be rectified into a direct current. The controller 406 may determine that the flame 500 is present by detecting the direct current at the flame sensor 300. In some embodiments, the controller 406 may regulate operation of the burner assembly 100 based on the determination. For example, the controller 406 may detect that the flame 500 is present and continue operation of the burner assembly 100 (e.g., by controlling the fuel valve 204 to supply fuel to the burner 200).

As set forth above, embodiments of the present disclosure may provide one or more technical effects useful for preventing oxidation on a surface of a flame sensor within a burner or burner assembly. Specifically, embodiments are directed a flame sensor having a sensor body configured to be disposed within a flame path of the burner, where the sensor body includes an anti-oxidation coating formed on an outer surface of the sensor body. The anti-oxidation coating is formed from an electrically conductive and oxidation-resistant metal, such as platinum. Thus, the flame sensor may be exposed to a flame within the burner and may function to detect the presence of the flame via flame rectification techniques while also being resistant to oxidation. In this way, the disclosed embodiments enable improved operation and longevity of the flame sensor. The technical effects and technical problems in the specification are examples and are not limiting. It should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A flame sensor for a furnace of a heating, ventilation, and air conditioning (HVAC) system, comprising:

a sensor body;

an electrically conductive member of the sensor body, wherein the electrically conductive member is configured to be disposed within a flame region of a burner of the furnace and configured to receive electrical current from a controller of the furnace; and an anti-oxidation coating disposed on an outer surface of the electrically conductive member and configured to transmit the electrical current from the electrically conductive member, wherein the anti-oxidation coating is configured to contact a flame produced by the burner and expose the electrical current to the flame, and wherein the anti-oxidation coating comprises a noble metal.

2. The flame sensor of claim 1, wherein the electrically conductive member is formed from a first material, the anti-oxidation coating is formed from a second material, and the first material and the second material are different from one another.

3. The flame sensor of claim 2, wherein the second material comprises platinum.

4. The flame sensor of claim 2, wherein the first material comprises an iron-chromium-aluminum alloy, nickel-chromium, or both.

5. The flame sensor of claim 1, wherein the anti-oxidation coating is a plated layer disposed on the outer surface of the electrically conductive member.

6. The flame sensor of claim 1, comprising a flange configured to mount the flame sensor to a combustion chamber housing of the burner.

7. The flame sensor of claim 6, comprising an insulation portion coupled to and disposed between the flange and the electrically conductive member.

8. The flame sensor of claim 7, wherein the insulation portion is disposed about the electrically conductive member, and the flange is disposed about the insulation portion.

9. A furnace, comprising:

a burner configured to produce a flame within a flame region of the burner; and a flame sensor coupled to the burner, wherein the flame sensor comprises:

an electrically conductive member disposed within the flame region of the burner, wherein the electrically conductive member is configured to receive electrical current from a controller of the furnace, and the electrically conductive member is formed from a first metallic material; and an anti-oxidation coating disposed on an outer surface of the electrically conductive member and configured to transmit the electrical current from the electrically conductive member, wherein the anti-oxidation coating is formed from a second metallic material comprising a noble metal, and the anti-oxidation coating is configured to contact the flame produced by the burner and expose the electrical current to the flame.

10. The furnace of claim 9, comprising the controller, wherein the controller is configured to transmit the electrical current to the electrically conductive member as an alternating current.

11. The furnace of claim 10, wherein the controller is configured to determine that the flame is present within the burner based on rectification of the alternating current to a direct current.

12. The furnace of claim 11, wherein the controller is electrically grounded to the burner.

13. The furnace of claim 9, wherein the anti-oxidation coating is a plated layer formed on the outer surface of the electrically conductive member.

14. The furnace of claim 9, wherein the burner comprises a burner housing, the flame sensor is mounted to the burner housing, and the flame sensor extends at least partially into the burner housing via an aperture formed in the burner housing.

15. The furnace of claim 14, wherein the flame sensor comprises an insulation portion disposed about the electrically conductive member, and the insulation portion is disposed within the aperture between the electrically conductive member and the burner housing.

16. A flame sensing system for a furnace of a heating, ventilation, and air conditioning (HVAC) system, comprising:

a flame sensor configured to be disposed within a flame region of a burner of the furnace, wherein the flame sensor comprises:

a main body portion formed from a metallic material and configured to receive electric current from a controller of the furnace; and an anti-oxidation coating formed on an outer surface of the main body portion, wherein the anti-oxidation coating is formed from a noble metal and is configured to transmit the electric current from the main body portion.

17. The flame sensing system of claim 16, comprising the controller, wherein the controller is configured to direct the electric current to the flame sensor as an alternating current, and the controller is configured to detect a presence of a flame based on detection of rectification of the alternating current into direct current.

18. The flame sensing system of claim 16, wherein the anti-oxidation coating is configured to expose the electric current to a flame.

19. The flame sensor of claim 1, wherein the anti-oxidation coating is configured to shield the electrically conductive member from oxygen within the flame region.

20. The flame sensing system of claim 16, wherein the anti-oxidation coating is configured to shield the main body portion from oxygen within the flame region.

* * * * *